US005470402A

United States Patent [19]

Nishino et al.

[11] Patent Number: 5,470,402

[45] Date of Patent: Nov. 28, 1995

[54] FERRITIC HEAT-RESISTANT CAST STEEL AND PROCESS FOR PRODUCING THE SAME

[75] Inventors: Kazuaki Nishino, Seto; Yoji Awano, Aichi; Hiroyuki Takamiya, Tajimi; Mitsufumi Ito, Nagoya; Masami Suzuki, Okazaki; Yoshikazu Genma, Toyota, all of Japan

[73] Assignees: Toyota Jidosha Kabushiki Kaisha, Toyota; Kabushiki Kaisha Toyota Chuo Kenkyusho, Aichi, Japan

[21] Appl. No.: 275,749

[22] Filed: Jul. 20, 1994

[30] Foreign Application Priority Data

Jul. 20, 1993 [JP] Japan ..... 5-201014

[51] Int. Cl.[6] ..... C22C 38/60; C22C 38/24; C21D 6/00

[52] U.S. Cl. ..... 148/325; 420/42; 148/540

[58] Field of Search ..... 148/325, 540; 420/42

[56] References Cited

U.S. PATENT DOCUMENTS 3,846,186 11/1974 Tipnis .

FOREIGN PATENT DOCUMENTS 649372 9/1962 Canada ..... 420/42

0087482 9/1983 European Pat. Off. .

0492674 7/1992 European Pat. Off. .

57-73170 5/1982 Japan .

1-159355 6/1989 Japan .

2-175841 7/1990 Japan .

5-59498 3/1993 Japan .

5-320830 12/1993 Japan .

392648 5/1933 United Kingdom ..... 75/128 P

*Primary Examiner*—Deborah Yee

*Attorney, Agent, or Firm*—Oblon, Spivak, McClelland, Maier & Neustadt

[57] ABSTRACT

A ferritic heat-resistant cast steel includes C in an amount of from 0.1 to 0.4% by weight, Si in an amount of from 0.5 to 2.0% by weight, Mn in an amount of 1.0% by weight or less, S in an amount of from 0.06 to 0.20% by weight, Ni in an amount of 1.0% by weight or less, Cr in an amount of from 13 to 20% by weight, V in an amount of from 0.2 to 1.0% by weight, at least one element selected from the group consisting of Nb in an amount of from 0.1 to 0.4% by weight, Mo in an amount of from 0.1 to 2.0% by weight, and W in an amount of from 0.2 to 4.0% by weight, and the balance of Fe and inevitable impurities, the S being dispersed as sulfides in the ferritic heat-resistant cast steel. It can further include at least one element selected from the group consisting of Te in an amount of from 0.01 to 0.1% by weight and Al in an amount of from 0.01 to 0.5% by weight. It can be produced by melting and casting the alloying elements and thereafter by annealing the resulting cast product at a temperature of from 750° to 1,000° C.

17 Claims, 8 Drawing Sheets

(×400)

(×400)

(×400)

(×400)

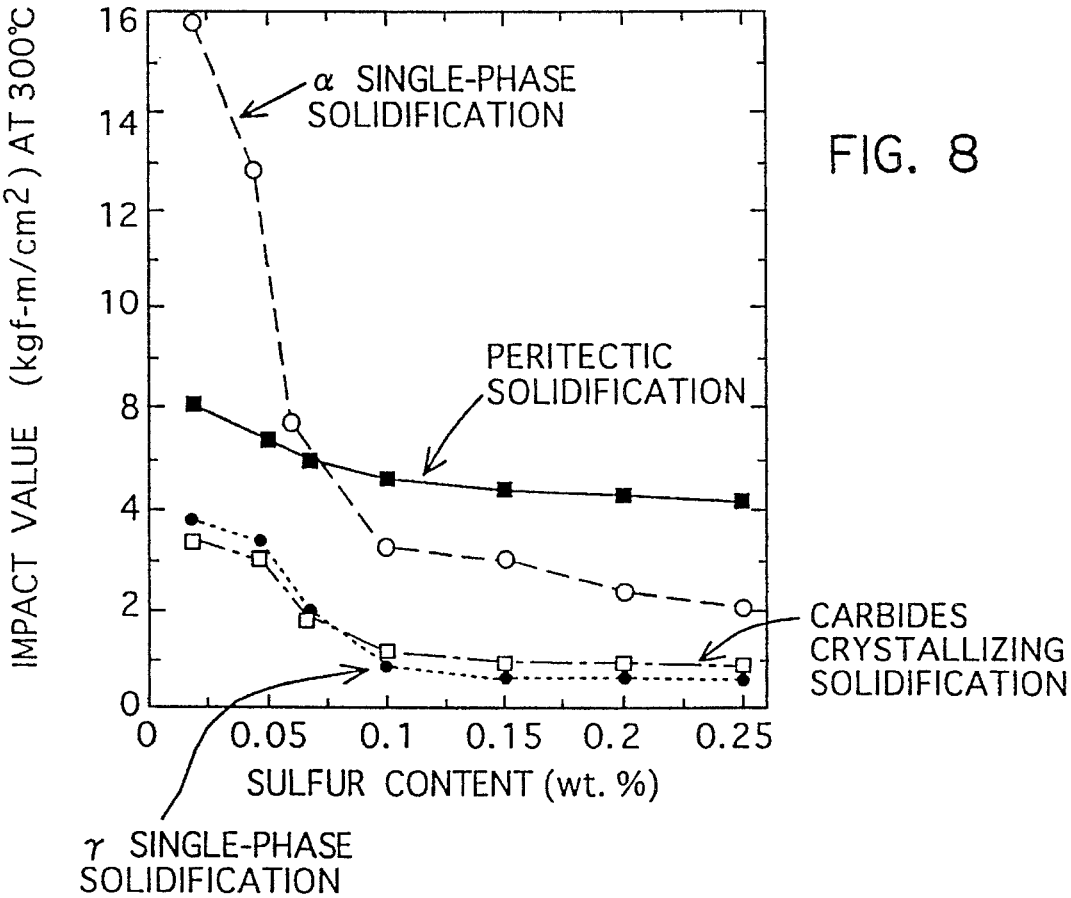
FIG. 8
FIG. 9
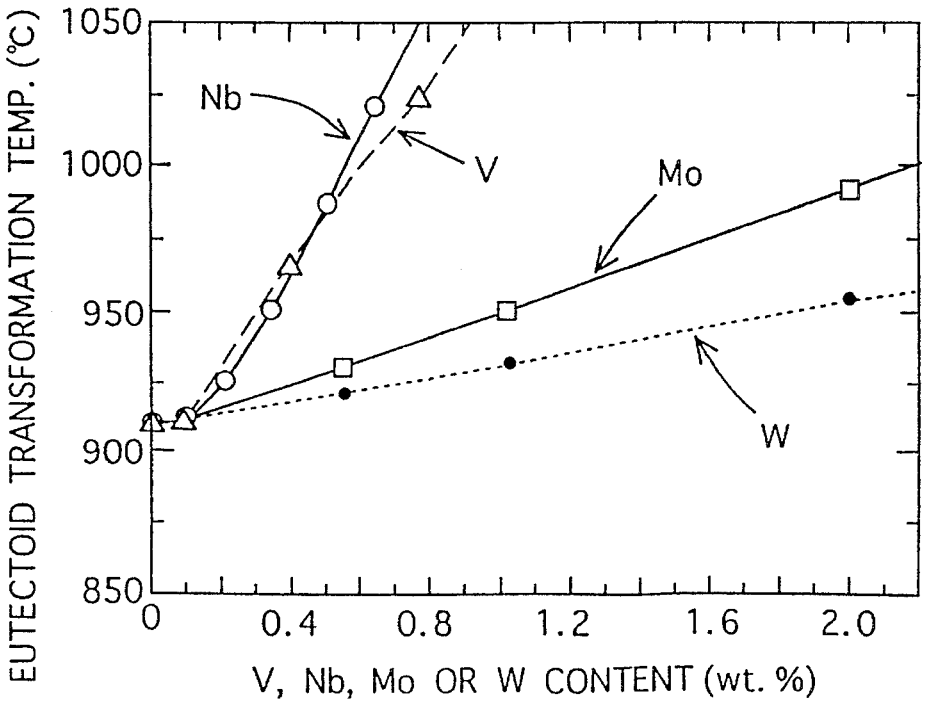

(×400)
EXAMPLE NO.2

(×400)
COMP. EX. NO.2

FERRITIC HEAT-RESISTANT CAST STEEL AND PROCESS FOR PRODUCING THE SAME

BACKGROUND OF THE INVENTION

1. Field of the Invention

The present invention relates to a heat-resistant cast steel which can be appropriately applied to component parts or the like for exhaust systems for automobile engines. More particularly, it relates to a ferritic heat-resistant cast steel which has excellent machinability, which simultaneously has good toughness and thermal fatigue resistance and which can be produced at less expensive production cost, and a process for producing the same.

2. Description of the Related Art

Recently, vehicle engines, especially automobile engines, have been improved in terms of combustion in order to fulfill the low fuel consumption requirement and the environment friendly requirement. As a result, the temperature of the exhaust gases tends to increase.

Hence, instead of the high-silicon-content nodular graphite cast iron employed conventionally and widely, ferritic heat-resistant cast steel has come to make the component parts, for the exhaust systems, such as the exhaust manifolds, the turbine housings of the turbo chargers, the component parts of the exhaust gas purifying apparatuses and the like. Although the ferritic heat-resistant cast steel is superior to the high-silicon-content nodular graphite cast iron in terms of heat resistance, it is remarkably inferior thereto in terms of machinability. Accordingly, it pushes up manufacturing cost and deteriorates productivity. In order to improve the machinability of steel, it has been known that the addition of sulfur is effective. For example, as set forth in page 416 of "*Stainless Steel Binran* (Stainless Steel Handbook in Japan)," an SUS430F steel containing sulfur in an amount of 0.15% by weight or more is available as one of ferritic stainless steels according to JIS (Japanese Industrial Standard).

However, when sulfur is added to the conventional ferritic heat-resistant cast steels, the addition degrades the thermal fatigue resistance of them. Hence, the content of sulfur has been limited to as small as the trace amount of inevitable impurities or less. For example, in SCH1, one of the ferritic heat-resistant cast steels as per JIS, and the ferritic heat-resistant cast steels disclosed in Japanese Unexamined Patent Publication (KOKAI) No. 1-159,355 and Japanese Unexamined Patent Publication (KOKAI) No. 2-175,841, the sulfur content is limited to 0.04% by weight or less. Exceptionally, in Japanese Unexamined Patent Publication (KOKAI) No. 5-59,498, there is disclosed a ferritic heat-resistant cast steel whose matrix includes C in an amount of from 0.05 to 0.5% by weight, Si in an amount of from 1 to 2% by weight and Cr in an amount of from 10 to 20% by weight, and in which a heat-resistance-giving element, such as Nb, V and Mn, is added in an amount of from about 0.1 to 1% by weight. According to this publication, the sulfur content can be increased up to 0.2% by weight.

When sulfur is added to the ferritic heat-resistant cast steel disclosed in Japanese Unexamined Patent Publication (KOKAI) No. 5-59,498 above, the resulting cast steel is improved in terms of machinability as compared to that of SCH1, however, it is inferior thereto in terms of toughness and thermal fatigue resistance. For example, it is liable to break when it is subjected to mechanical shocks in the manufacturing processes of the cast products for the exhaust systems. Further, the thus obtained cast products are likely to crack during their service where the tensile thermal stresses act concentratedly.

In addition, the conventional ferritic heat-resistant cast steels free from the sulfur addition were far inferior to the high-silicon-content nodular graphite cast iron in terms of machinability.

Therefore, in order to solve the problems associated with the conventional ferritic heat-resistant cast steels with sulfur added, the inventors of the present invention investigated the variation of the toughness with respect to the sulfur addition, the relationship between the toughness and the sulfides distribution, and the relationship between the resistance against the cracking resulting from the thermal fatigue (hereinafter simply referred to as "thermal fatigue resistance") and the toughness as well as the tensile strength properties.

First, the present inventors examined the deterioration of the toughness due to the sulfur addition by carrying out the Charpy impact test in a temperature range of from room temperature to 300° C. As a result, they appreciated that, in the temperature range of from room temperature to 300° C., the ferritic heat-resistant cast steels with sulfur added have a ductile-brittle transition temperature (hereinafter simply referred to as "transition temperature"), which is generally appreciated in ferritic alloys as set forth in page 154 of "*Stainless Steel Binran* (Stainless Steel Handbook in Japan)." At the same time, they recognized that the cast steels with sulfur added exhibit a remarkably decreased impact value at the transition temperature or more (hereinafter simply referred to as "intermediate temperature toughness"). Hence, they revealed that it is important to closely observe the intermediate toughness of the cast steels and to inhibit it from deteriorating in order to improve machinability by adding sulfur.

Second, the present inventors studied the relationship between the sulfides distribution and the intermediate temperature toughness in the ferritic heat resistance cast steels with sulfur added. As a result, in the ferritic heat-resistant cast steel disclosed in Japanese Unexamined Patent Publication (KOKAI) No. 5-59,498, the Nb carbides crystallize in interdendritic regions like a network during the solidification with or without the sulfur addition. However, they found that, when sulfur is added, the sulfides crystallize together with the Nb carbides and the interdendritic regions are embrittled, and that the cast steel exhibits a sharply deteriorated intermediate temperature toughness accordingly. Therefore, they realized that, in order to inhibit the deterioration of the intermediate temperature toughness due to the sulfur addition, it is important to uniformly distribute the sulfides crystallizing during the solidification without localizing them. Consequently, they discovered that it is necessary to suppress the Nb addition amount to a small amount which enables not to crystallize the Nb carbides in the interdendritic regions like a network during the solidification.

Third, the present inventors investigated the relationship between the thermal fatigue resistance and the toughness as well as the tensile strength properties. As a result, they noticed that, when sulfur is added to the ferritic heat-resistant cast steels, the cast steels exhibit a decreasing thermal fatigue resistance, but that the cast steels had the virtually invariable tensile strength properties, such as proof stress, tensile strength and elongation, in a temperature range of from room temperature to elevated temperatures, and that there is no correlation between the thermal fatigue resistance and the tensile strength properties. On the other hand, they found that there is a good correspondence between the thermal fatigue resistance deterioration and the intermediate temperature toughness deterioration. Thus, in the ferritic heat-resistant cast steels with sulfur added, they revealed that, in order to upgrade the thermal fatigue resistance, it is extremely important to inhibit the intermediate temperature toughness (hereinafter simply abbreviated to as "toughness") from deteriorating.

Based on the novel discoveries described above, the present inventors aimed at the following. Namely, they preliminarily inquired into the formation processes of the solidified metallic structure of the ferritic heat-resistant cast steel, and the relationship between the crystallizing sulfides distribution and the toughness.

First of all, the present inventors studied the formation processes of the solidified metallic structure of the ferritic heat-resistant cast steel, and they found that, depending on the alloy compositions, there are mainly following four formation processes:

(a) Similarly to the aforementioned Nb carbides, the carbides crystallize in the interdendritic regions during the solidification (hereinafter simply referred to as "carbides crystallizing solidification");

(b) Only the ferrite phase (hereinafter simply referred to as "alpha") crystallizes during the solidification, and the solidification terminates at the "alpha" single-phase (hereinafter simply referred to as "alpha" single-phase solidification");

(c) The "alpha" crystallized first as primary crystal, and thereafter part of primary "alpha" and part of the remaining liquid phase cause a peritectic reaction to crystallize the austenite phase (hereinafter simply referred to as "gamma"), and the solidification terminates at the mixed phase of "alpha" and "gamma" (hereinafter simply referred to as "peritectic solidification"); and (d) Similarly to (c), there occurs the peritectic reaction during the solidification, but the solidification terminates at the "gamma" single-phase (hereinafter simply referred to as ""gamma" single-phase solidification").

Then, the present inventors added sulfur to the four ferritic heat-resistant cast steels which had undergone the aforementioned four different solidification processes, and they examined the resulting four cast steels for the relationship between the crystallizing sulfides distribution and the toughness. As a result, they discovered the following:

The cast steel undergone process (a), i.e., the carbides crystallizing solidification, exhibits a sharply deteriorating toughness when the sulfur addition amount is increased, because the sulfides crystallize along the carbides and densely localize in the interdendritic regions in a manner similar to the aforementioned crystallization of the Nb carbides;

The cast steel undergone process (b), i.e., the "alpha" single-phase solidification, exhibits a sharply deteriorating toughness when the sulfur addition amount is increased, because the sulfides mainly crystallize along the "alpha" crystalline grain boundaries and densely localize therein so as to embrittle them;

The cast steel undergone process (d), i.e., the "gamma" single-phase solidification, exhibits a sharply deteriorating toughness when the sulfur addition amount is increased, because the sulfides mainly crystallize along the "gamma" crystalline grain boundaries and densely localize therein so as to embrittle them; and On the other hand, the cast steel undergone process (c), i.e., the peritectic solidification, exhibits a toughness which is inhibited from deteriorating even when the sulfur addition amount is increased, because the sulfides do not localize along the specific structures but distribute uniformly therein.

Based on these novel discoveries, the present inventors designed a ferritic heat-resistant cast steel so as to cause the peritectic solidification, and so as to heighten the eutectoid transformation temperature and elevated temperature proof stress which effect the thermal fatigue resistance, and then they added sulfur to the resulting cast steel. Thus, they completed a ferritic heat-resistant cast steel which is superior to the conventional steels free from sulfur addition in terms of machinability, and which, in spite of the sulfur addition capable of improving the machinability equivalent to that of the conventional steels with sulfur added, is tougher and more thermal fatigue resistant than the conventional steels.

SUMMARY OF THE INVENTION

It is therefore a primary object of the present invention to provide a ferritic heat-resistant cast steel whose machinability is improved by a sulfur addition, in which the toughness deterioration resulting from the sulfur addition is simultaneously inhibited by controlling the distribution of the sulfides crystallizing during solidification by means of the peritectic reaction, in which the alloying elements other than the sulfur are compounded so as to upgrade the toughness, the eutectoid transformation temperature and the elevated temperature proof stress, and which is superb in terms of the thermal fatigue resistance. It is a secondary object thereof to provide a process for producing the novel cast steel.

A ferritic heat-resistant cast steel according to the present invention comprises:

C in an amount of from 0.1 to 0.4% by weight;

Si in an amount of from 0.5 to 2.0% by weight;

Mn in an amount of 1.0% by weight or less;

S in an amount of from 0.06 to 0.20% by weight;

Ni in an amount of 1.0% by weight or less;

Cr in an amount of from 13 to 20% by weight;

V in an amount of from 0.2 to 1.0% by weight;

at least one element selected from the group consisting of Nb in an amount of from 0.1 to 0.4% by weight, Mo in an amount of from 0.1 to 2.0% by weight, and W in an amount of from 0.2 to 4.0% by weight; and the balance of Fe and inevitable impurities, the S being dispersed as sulfides in the ferritic heat-resistant cast steel.

The reasons will be hereinafter described in detail why the alloying elements are limitedly included in the aforementioned composition ranges in the present ferritic heat-resistant cast steel.

(1) C

C is an indispensable element for causing the peritectic reaction during the solidification, and it is effective to improve the present ferritic heat-resistant cast steel in terms of the elevated temperature strength and the molten metal flowability (i.e., castability). When Cr is included in an amount of 13% by weight or more like the present cast steel and simultaneously when C is included in an amount of less than 0.1% by weight, the peritectic reaction barely occurs in the resulting cast steels and the elevated temperature strength and the castability are not improved satisfactorily. When C is included in an amount of more than 0.4% by weight, the peritectic reaction hardly occurs in the resulting cast steels but the "gamma" single-phase solidification occurs therein, thereby not only deteriorating the toughness but also lowering the eutectoid transformation temperature. Therefore, C is included in the amount of from 0.1 to 0.4% by weight, further preferably in an amount of from 0.15 to 0.38% by weight.

(2) Si

Si improves the oxidation resistance, increases the eutectoid transformation temperature and upgrades the castability, and it is effective as a deoxidizing agent. When Si is included in an amount of less than 0.5% by weight, these advantageous effects are not produced sufficiently. When Si is included in an amount of more than 2.0% by weight, the resulting cast steels are deteriorated in terms of the toughness and they are less likely to undergo the peritectic reaction. Thus, Si is included in the amount of from 0.5 to 2.0% by weight, further preferably in an amount of from 0.8 to 1.7% by weight.

(3) Mn

Mn combines with sulfur to produce sulfides so as to improve the machinability, deoxidizes the molten metal, and enhances the castability. It is a desirable element to add to the present ferritic heat-resistant cast steel. However, even when Mn is not added, sulfur combines mainly with Cr to produce sulfides, and accordingly there arises machinability improvement equivalent to that effected by the Mn addition. Further, since Mn is an element capable of producing the austenite phase, it lowers the eutectoid transformation temperature, and degrades the oxidation resistance when it is added too much. Hence, Mn is included in the amount of 1.0% by weight or less, further preferably in an amount of from 0.2 to 0.8% by weight.

(4) S

S combines mainly with Mn, Fe and Cr to produce sulfides, and thus it is an important element in order to improve the machinability. When S is included in an amount of less than 0.06% by weight, this advantageous effect is not produced adequately. When S is included in an amount of more than 0.2% by weight, the advantageous effect cannot be expected any further and simultaneously the resulting cast steels degrade in terms of the oxidation resistance. Therefore, S is included in the amount of from 0.06 to 0.2% by weight, further preferably in an amount of from 0.08 to 0.18% by weight.

(5) Cr

Cr improves the oxidation resistance and increases the eutectoid transformation temperature, and accordingly it is an extremely important element. When Cr is included in an amount of less than 13% by weight, these advantageous effects are not produced appropriately. When Cr is included in an amount of more than 20%, the peritectic reaction is less likely to occur, thereby deteriorating the toughness of the resulting cast steels. Thus, Cr is included in the amount of from 13 to 20% by weight, further preferably in an amount of from 15 to 19% by weight.

(6) V

V produces the advantageous effects of increasing the eutectoid transformation temperature greatly. However, the "gamma" crystallized during the peritectic reaction is decomposed to the "alpha" and the carbides of Cr by cooling subsequent to the solidification or by a heat treatment following the casting, and the resulting carbides of Cr degrade the toughness of the thus obtained cast steels. On the other hand, during the cooling subsequent to the solidification, V produces their carbides preferentially to Cr and inhibits the crystallization of the carbides of Cr. Consequently, V enhances the toughness. When V is included in an amount of less than 0.2% by weight, these advantageous effects are not produced satisfactorily. When V is included in an amount of more than 1.0% by weight, the resulting cast steels are degraded sharply in terms of the oxidation resistance. Thus, V is included in the amount of from 0.2 to 1.0% by weight, further preferably in an amount of from 0.4 to 0.8% by weight.

(7) Nb

Nb produces, similarly to V, the advantageous effects of increasing the eutectoid transformation temperature greatly. When Nb is added in a trace amount, it enhances the elevated temperature proof stress. However, when Nb is included in an amount of less than 0.1% by weight, these advantageous effects are not produced sufficiently. When Nb is included in an amount of more than 0.4% by weight, the Nb carbides crystallize in the interdendritic regions like a network, the sulfides crystallize along the Nb carbides, and consequently the resulting cast steels are deteriorated considerably in terms of the toughness and the elevated temperature strength. Hence, Nb is included in the amount of from 0.1 to 0.4% by weight, further preferably in an amount of from 0.15 to 0.35% by weight.

(8) Mo

Mo produces, similarly to V, the advantageous effects of increasing the eutectoid transformation temperature greatly. Further, it solves into the ferrite phase so as to enhance the elevated temperature proof stress. Accordingly, it is possible to improve these properties by compositely adding Mo with V or by compositely adding Mo with Nb. However, when Mo is included in an amount of less than 0.1% by weight, these advantageous effects are not produced appropriately. When Mo is included in an amount of more than 2.0% by weight, the peritectic reaction is less likely to occur. Therefore, Mo is included in the amount of from 0.1 to 2.0% by weight, further preferably in an amount of from 0.2 to 1.5% by weight.

In addition, W similarly produces the advantageous effects as those produced by Mo. Accordingly, instead of Mo, W can be included in the present ferritic heat-resistant cast steel. However, in order to produce the advantageous effects equivalent to those produced by Mo, it is necessary to add W in an amount twice that of Mo, for instance, in an amount of from 0.2 to 4.0% by weight.

(9) Ni

It is inevitable for ferritic heat-resistant cast steels like the present one to include Ni, as an inevitable impurity, in a certain amount. Ni renders the peritectic reaction likely to occur, and solves into the "alpha" so as to enhance the toughness. However, Ni reduces the eutectoid transformation temperature. Thus, Ni is included in the amount of from 1.0% by weight or less, further preferably in an amount of from 0.01 to 0.9% by weight.

In particular, in the present ferritic heat-resistant cast steel, the ferritic matrix immediately after the solidification comprises a mixed phase including the ferrite phase and the austenite phase formed by the peritectic reaction during the solidification. It is preferred that the austenite phase formed by the peritectic reaction occupies from 20 to 80% by area of the mixed phase. When the austenite phase occupies less than 20% by area of the mixed phase, the resulting cast steels exhibit a much lower toughness, because a part of the sulfides crystallize continuously along the grain boundary of the ferrite. When the austenite phase occupies more than 80% by area of the mixed phase, the resulting cast steels also exhibit a much lower toughness, because a part of the sulfides crystallize continuously along the grain boundary of the austenite.

In a preferred form, the present ferritic heat-resistant cast steel can further comprise at least one element selected from the group consisting of Te in an amount of from 0.01 to 0.1% by weight and Al in an amount of from 0.01 to 0.5% by weight.

The preferred form of the present ferritic heat-resistant cast steel is further enhanced in terms of the machinability and the thermal fatigue resistance. The reasons are discussed below why the additional alloying elements are limitedly included in the aforementioned composition ranges in the preferred form of the present cast steel.

(10) Te

Te adheres to the sulfides of Mn, Fe and Cr, thereby upgrading the machinability. When Te is included in an amount of less than 0.1% by weight, the advantageous effect is not produced satisfactorily. When Te is included in an amount of more than 0.1% by weight, the advantageous effect is not produced any further and such addition adversely affects the economics. Thus, Te is included in the amount of from 0.01 to 0.1% by weight, further preferably in an amount of from 0.02 to 0.08% by weight.

(11) Al

Al distributes the sulfides further uniformly so as to further improve the machinability, and also enhances the oxidation resistance. When Al is included in an amount of less than 0.01% by weight, these advantageous effect are not produced sufficiently. When Al is included in an amount of more than 0.5% by weight, such addition adversely affects the castability. Hence, Al is included in the amount of from 0.01 to 0.5% by weight, further preferably in an amount of from 0.02 to 0.4% by weight.

The present ferritic heat-resistant cast steel can be produced by a process according to the present invention. The process comprises the steps of:

selecting and casting a raw material having the composition of the present cast steel or the preferred form thereof; and annealing the resulting cast product at a temperature of from 750° to 1,000° C.

In the present ferritic heat-resistant cast steel, by adding no Nb or by limitedly adding Nb as small as possible, the Nb carbides can be substantially inhibited from crystallizing during the solidification. Accordingly, the sulfides can be inhibited from crystallizing along the Nb carbides. Further, the addition of the alloying elements other than sulfur is controlled so as to cause the peritectic reaction which enables to react the "alpha" and the liquid phase to crystallize the "gamma" and to terminate the solidification at the mixed phase of the "alpha" and "gamma," thereby distributing the sulfides nearly uniformly in the ferritic matrix. Consequently, regardless of the sulfur addition, the present cast steel can be inhibited from degrading in terms of the toughness. Furthermore, since the present cast steel includes sulfur in the amount of 0.06% by weight or more, it can be sharply upgraded in terms of the machinability. Moreover, since the present cast steel can include V so as to enhance the toughness and the eutectoid transformation temperature, it can be improved in terms of the thermal fatigue resistance as well.

In addition to the improvements in the present ferritic heat-resistant cast steel, the preferred form thereof can be further improved in terms of the machinability by adding either Te or Al. In particular, when it includes Al, it can be upgraded in terms of the oxidation resistance and accordingly it can be further improved in terms of the thermal fatigue resistance.

The present ferritic heat-resistant cast steel and the preferred form thereof is characterized in that there arises the peritectic reaction which enables to terminate the solidification at the mixed phase of the "alpha" and "gamma." Accordingly, when the cooling rate subsequent to the casting is set small, the "gamma" is transformed to the "alpha" during cooling to room temperature immediately after the solidification. However, when the cooling rate subsequent to the casting is set large, the "gamma" is transformed to the martensite phase during cooling to room temperature, thereby increasing the hardness of the matrix and degrading the machinability. In accordance with the present process for producing the present cast steel, the resulting cast product is subjected to the annealing after the casting. In the annealing, the martensite phase is transformed to the "alpha" by heating in the temperature range of 750° to 1,000° C. As a result, the hardness of the present cast steel can be softened satisfactorily.

As having been described so far, in accordance with the present invention, the present ferritic heat-resistant cast steel can be improved remarkably in terms of the machinability, because, as compared to the conventional ferritic heat-resistant cast steels whose sulfur content is limited to as small as the trace amount or less of the inevitable impurities, it includes sulfur in such a large amount that the sulfides containing Mn, Fe and Cr as the major components can be dispersed therein. Further, as compared to the conventional ferritic heat-resistant cast steels with sulfur added, its toughness degradation due to the sulfur addition can be suppressed to minimum, because the Nb carbides can be little crystallized during the solidification by adding no Nb or by adding Nb in the controlled amount and the sulfides are hardly localized in the interdendritic regions, because the sulfides can be dispersed fairly uniformly by combining the alloying elements, excepting sulfur, so as to cause the peritectic solidification. As mentioned earlier, the peritectic solidification enables to react the "alpha" with the liquid phase to crystallize the "gamma," and it enables to terminate the solidification at the mixed phase of the "alpha" and "gamma." Furthermore, it can have the thermal fatigue resistance which is equivalent to or superior to that of the conventional ferritic heat-resistant cast steels with sulfur added, because the V or Mo addition can compensate the eutectoid transformation temperature decrement resulting from no Nb addition or the limitedly small Nb addition amount, and because the V or Mo addition simultaneously upgrades its toughness and elevated temperature proof stress.

In addition to the advantageous effects produced by the present ferritic heat-resistant cast steel, the preferred form thereof can be further improved in terms of the machinability and the thermal fatigue resistance, because it further includes either Te or Al.

Moreover, in accordance with the present invention, the present process for producing the present ferritic heat-resistant cast steel comprises, after casting, the step of annealing the resulting cast product at the temperature of from 750° to 1,000° C., in which the martensite phase is transformed to the "alpha," thereby softening the hardness of the present cast steel sufficiently. As a result, the present cast steel can be further upgraded in terms of the machinability.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 8 is a diagram for illustrating how the sulfur addition affected the impact value of the examples of the present ferritic heat-resistant cast steel;

FIG. 9 is a diagram for illustrating how the V, Nb, Mo and W contents affected the eutectoid transformation temperature of the examples of the present ferritic heat-resistant cast steel;

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

The examples of the present ferritic heat-resistant cast steel will be hereinafter described with reference to the accompanied drawings.

First of all, a conventional steel was prepared, and it included C in an amount of 0.2% by weight, Si in an amount of 1.5% by weight, Mn in an amount of 0.6% by weight, P in an amount of 0.020% by weight or less, Cr in an amount of 16% by weight, V in an amount of 0.4% by weight, Nb in an amount of 0.7% by weight, Mo in an amount of 0.2% by weight, Ce in an amount of 0.05% by weight, and the balance of Fe. The conventional steel was made into test specimens by high frequency induction melting followed by casting with a sand mold, and the resulting cast products were annealed at 930° C. for 3 hours. The thus obtained test specimens were examined for the toughness dependency on the sulfur addition, the thermal fatigue resistance dependency thereon, and the relationships between the toughness and the tensile strength properties.

Figure 1:
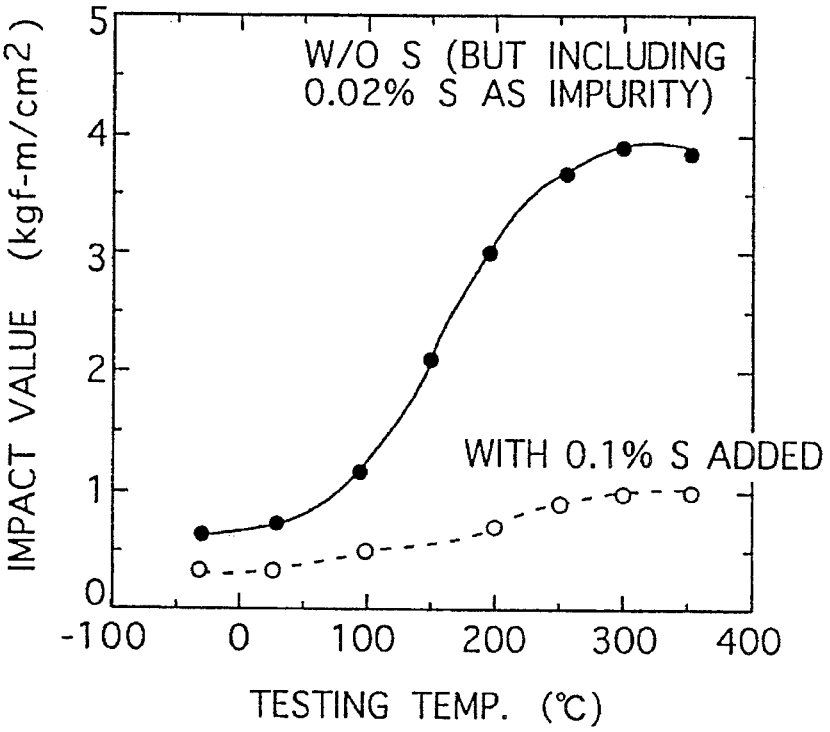
FIG. 1 is a diagram for illustrating how the sulfur addition affected the impact value of the examples of the present ferritic heat-resistant cast steel.
Figure 2A:
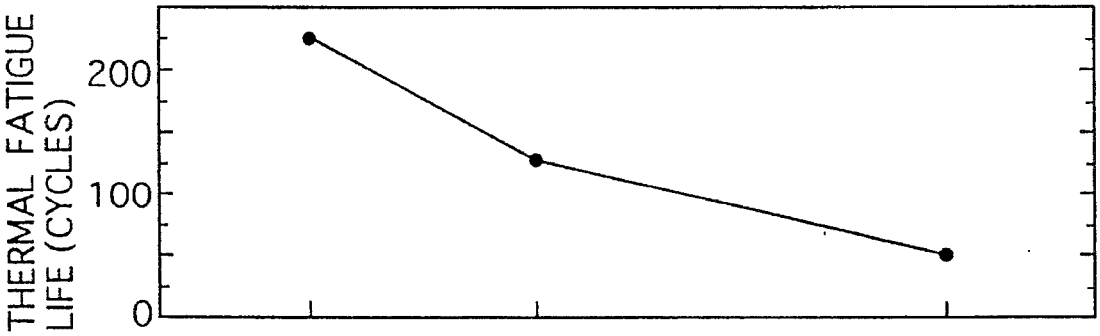
FIG. 2 is a set of diagrams for illustrating how the sulfur addition affected the thermal fatigue resistance, the intermediate temperature toughness and the tensile strength properties of the examples of the present ferritic heat-resistant cast steel.
Figure 2B:
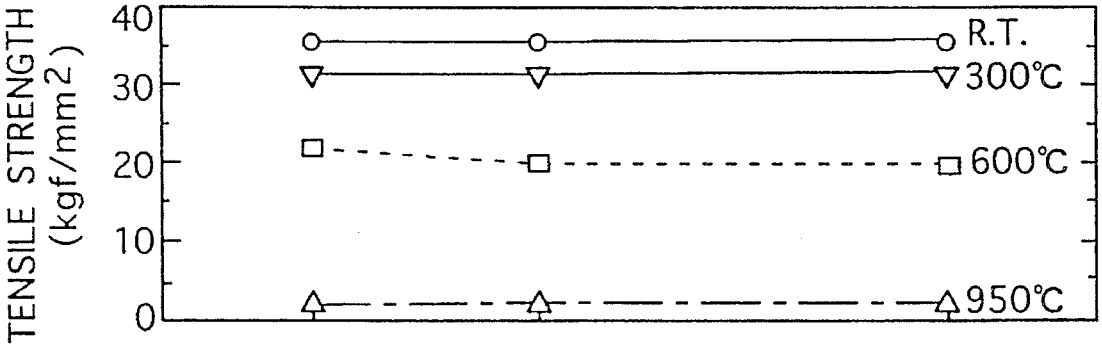
Figure 2C:
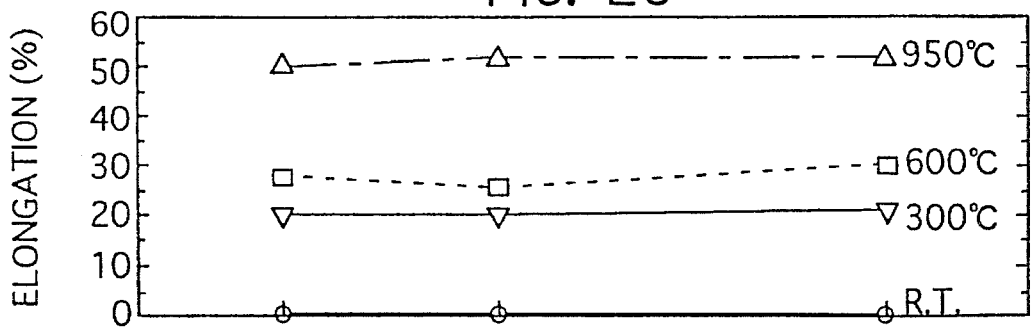
Figure 2D:
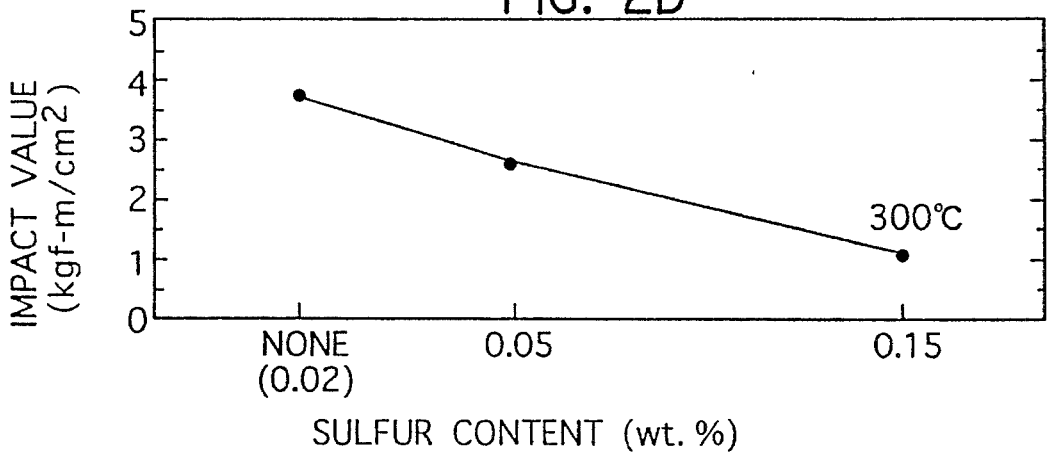

FIG. 1 illustrates the results of the evaluation on how the sulfur addition affected the toughness of the alloy without the sulfur addition but including S in an amount of 0.02% by weight as an inevitable impurity and the toughness of the alloy with the sulfur addition and including S in an amount of 0.1% by weight. This evaluation was conducted by carrying out the Charpy impact test using the JIS #4 test specimen in a temperature range of from −40° to 300° C. With or without the sulfur addition, the impact strength was small remarkably at room temperature, but it increased sharply at elevated temperatures. Thus, the alloys were found to exhibit a ductile-brittle transition temperature. Further, when sulfur was added, the impact strength decreased at all temperatures. However, the extent of the decrement was remarkably larger at elevated temperatures (e.g., the transition temperature or higher) than it was at temperatures around room temperature where the cleavage fracture occurred. Therefore, it is apparent that, when sulfur is added, it is extremely important to inhibit the toughness (i.e., the intermediate temperature toughness) from deteriorating in the elevated temperature range.

FIG. 2 illustrates the results of the examinations for the thermal fatigue resistance dependency on the sulfur content and the relationships between the toughness and the tensile strength properties. A thermal fatigue test was carried out by completely holding a test specimen at opposite ends and by repeatedly subjecting it to a thermal cycle of from 250° to 950° C. Thus, the test specimens were examined for their life until they fractured. The test specimen had a diameter of 10 mm, a gage length of 25 mm and a total length of 160 mm. Further, a tensile strength properties test was carried out by pulling a test specimen having a diameter of 10 mm, a gage length of 50 mm and a total length of 98 mm at a strain rate of 3%/min.

It is appreciated from the results thus obtained that the the thermal fatigue life deteriorated as the sulfur content increased. On the other hand, regardless of the sulfur content, the tensile strength and the elongation did not vary substantially at all testing temperatures. However, the impact strength at 300° C. decreased with the sulfur content. Thus, the thermal fatigue resistance deterioration with the sulfur addition and the toughness degradation therewith corresponded well. Therefore, it is obvious that, in order not to deteriorate the thermal fatigue resistance, it is important to inhibit the toughness degradation due to the sulfur addition.

In order to solve the problems of the conventional steels and to find out a way for controlling the distribution of the sulfides in the examples of the present ferritic heat-resistant cast steel, the present inventors investigated the relationship between the formation processes of the solidification structure of conventional ferritic heat-resistant cast steels and their sulfides distributions. Namely, a conventional steel was prepared, and it included Si in an amount of 1.0% by weight, Mn in an amount of 0.6% by weight, Cr in an amount of 16.0% by weight, and the balance of Fe. Then, carbon was added to the conventional steel in various amounts, and sulfur was added thereto in an amount of 0.15% by weight.

The resulting alloys were melted, solidified and thereafter cooled rapidly, and they were examined for the resulting micro-structure with an optical microscope. Likewise, the alloy with C added in a fixed amount of 0.2% by weight and further including Nb in an amount of 0.7% by weight was subjected to the same examination. Moreover, in the four alloys undergone the above-described four different solidification processes, the sulfur addition amount was changed variously, and the resulting alloys were examined for the toughness variation.

Figure 3:
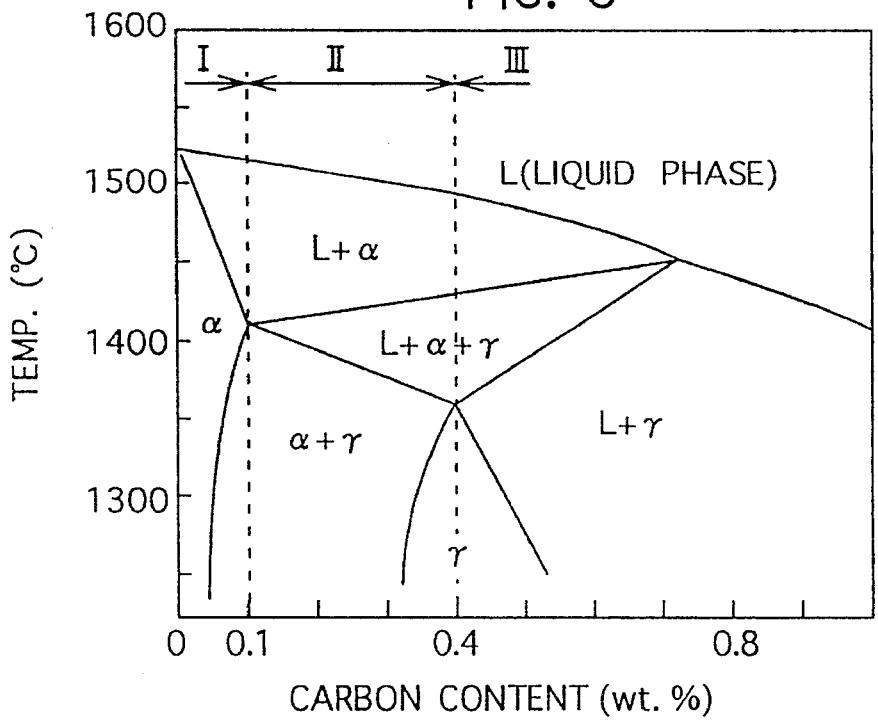
FIG. 3 is a phase diagram for illustrating the solidification processes which Fe-1.0Si-0.6Mn-16.0Cr—C alloys underwent.

According to the observations on the metallic structures, a phase diagram was obtained which illustrates the solidification processes undergone by the Fe-1.0Si-0.6Mn-16.0Cr-C alloys as shown in FIG. 3. When the alloys included C in an amount of 0.1% by weight or less (i.e., the area "I"), they were found to undergo the solidification process in which only the "alpha" crystallized during the solidification and the solidification terminated at the "alpha" single-phase, and thus they were found to be the "alpha" single-phase solidification alloys. When the alloys included C in an amount of from 0.1 to 0.4% by weight (i.e., the area "II"), they were found to undergo the solidification process in which the "alpha" crystallized first as primary crystal, thereafter part of the primary "alpha" and part of the remaining liquid phase caused the peritectic reaction to crystallize the "gamma" phase and the solidification terminated at the mixed phase of "alpha" and "gamma," and thus they were found to be the peritectic solidification alloys. When the alloys included C in an amount of 0.4% by weight or more (i.e., the area "III"), they were found to undergo the solidification process in which the peritectic reaction occurred, similarly to the alloys lying in the area "II," during the solidification, but thereafter the "alpha" was converted into the "gamma" and the solidification terminated at the "gamma" single-phase, and thus they were found to be the "gamma" single-phase solidification alloys. Hence, the solidification process of the alloys including Fe, Si, Mn, Cr and C (i.e., the basic elements of ferritic heat-resistant cast steel) was found to be roughly classified into the aforementioned three solidification processes.

Figure 4:
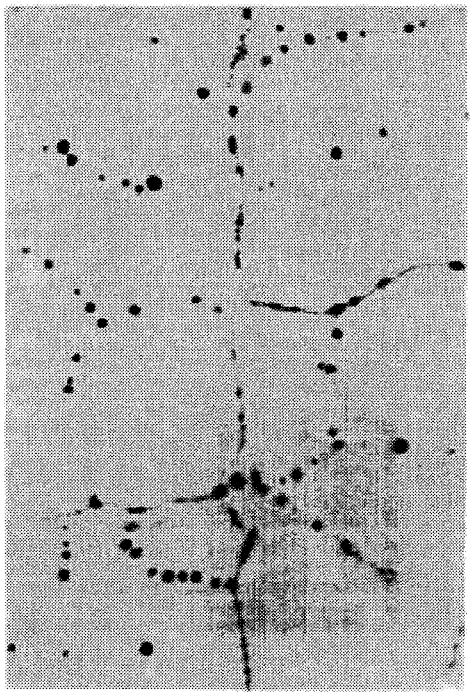
FIG. 4 is a photograph for showing the metallic structure of the alloy which lay in the area designated at "I" of FIG. 3.

FIG. 4 is a photograph for showing the sulfides distribution in the metallic structure of the alloy which lay in the area designated at "I" of FIG. 3. Sulfur was added in an amount of 0.15% by weight to the alloy including C in an amount of 0.05% by weight. In the "alpha" single-phase solidification alloy, a part of the sulfides were found to crystallize continuously along the crystalline grain boundaries of the "alpha."

Figure 5:
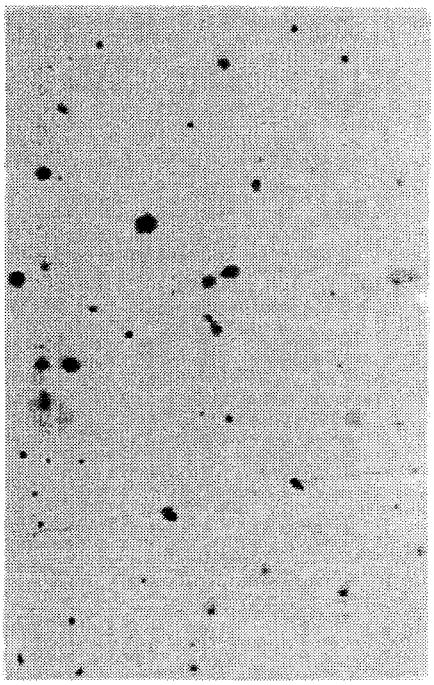
FIG. 5 is a photograph for showing the metallic structure of the alloy which lay in the area designated at "II" of FIG. 3.

FIG. 5 is a photograph for showing the metallic structure of the alloy which lay in the area designated at "II" of FIG. 3. Sulfur was added in an amount of 0.15% by weight to the alloy including C in an amount of 0.2% by weight. In the peritectic solidification alloy, unlike the alloy shown in FIG. 4, the sulfides were found not to crystallize along the crystalline grain boundaries but to crystallize substantially uniformly therein.

Figure 6:
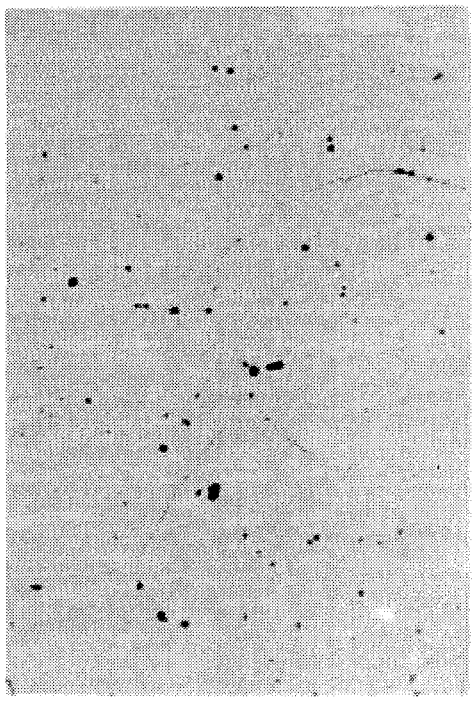
FIG. 6 is a photograph for showing the metallic structure of the alloy which lay in the area designated at "III" of FIG. 3.

FIG. 6 is a photograph for showing the metallic structure of the alloy which lay in the area designated at "III" of FIG. 3. Sulfur was added in an amount of 0.15% by weight to the alloy including C in an amount of 0.5% by weight. In the "gamma" single-phase solidification alloy, a part of the sulfides were found to crystallize along the crystalline grain boundaries of the "gamma."

Figure 7:
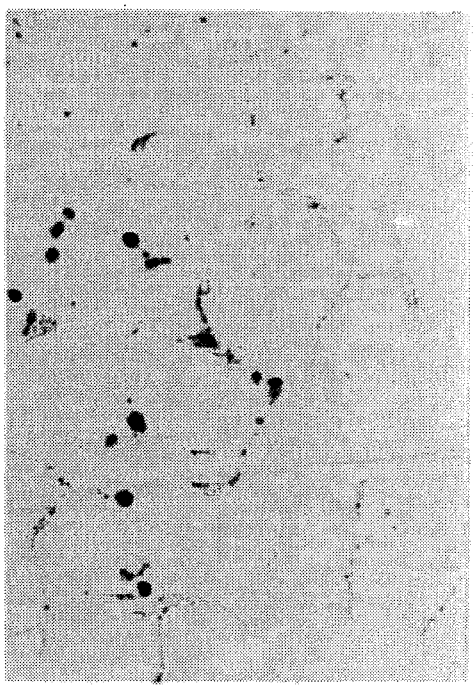
FIG. 7 is a photograph for showing the metallic structure of an Fe-0.2C-0.7Nb-0.15S alloy.

FIG. 7 is a photograph for showing the metallic structure of the alloy which included C in an amount of 0.2% by weight and Nb in an amount of 0.7% by weight, and to which sulfur was added in an amount of 0.15% by weight. When the alloy was free from the sulfur addition, it underwent the carbides crystallizing solidification in which the Nb carbides crystallized in the interdendritic regions like a network during the solidification. When sulfur was added to the alloy, the sulfides crystallized along the Nb carbides. Thus, it was found that the ferritic heat-resistant cast steel with Nb added in a large amount underwent the carbides crystallizing solidification, and that the sulfides crystallized along the carbides to localize therein.

FIG. 8 illustrates the results of the evaluation on how the impact value varied at 300° C. when sulfur was added in various amounts to the alloys shown in FIGS. 4 through 7 and undergone the four different solidification processes. The "alpha" single-phase solidification alloy exhibited a high toughness when it was free from the sulfur addition, but it exhibited a sharply decreasing toughness when sulfur was added in an amount of 0.05% by weight or more. The "gamma" single-phase solidification alloy and the carbides crystallizing solidification alloy exhibited a lower toughness even when they were free from the sulfur addition, and they exhibited a much lower toughness when sulfur was added in an amount of 0.05% by weight or more. On the other hand, the peritectic solidification cast steel exhibited a less decreasing toughness even when sulfur was added. According to the results of this evaluation, a novel discovery was obtained that, in the ferritic heat-resistant cast steel, it is possible to inhibit the toughness deterioration associated with the sulfur addition by controlling the alloying elements so as to cause the peritectic solidification.

Based on the novel discoveries, a master alloy was prepared in order to determine the basic composition of the present ferritic heat-resistant cast steel (i.e., a peritectic solidification alloy whose toughness is deteriorated less by the sulfur addition, whose machinability is exceptionally good, and at the same time whose eutectoid transformation temperature and elevated temperature proof stress are superb). The master alloy included C in an amount of 0.2% by weight, Si in an amount of 1.0% by weight, Mn in an amount of 0.6% by weight, Cr in an amount of 16.0% by weight, and the balance of Fe. Then, V, Nb, Mo, W and S were added in various amounts to the master alloy. The resulting alloys were melted and cast, and they were investigated how their properties were affected by the added elements. The eutectoid transformation temperature was evaluated by a thermal expansion measurement with a test specimen having a diameter of 10 mm and a total length of 30 mm. The elevated temperature proof stress was evaluated at 900° C. by a compression test with a test specimen having a diameter of 8 mm and a height of 12 mm. The machinability was evaluated by carrying out a machining test in which a worn width on a cutting tool flank was measured at a machined distance of 600 m.

FIG. 9 illustrates the results of the evaluation on how the V, Nb, Mo and W contents affected the eutectoid transformation temperature. When any one of the elements was added to the master alloy, the eutectoid transformation temperature was increased linearly. In particular, it is obvious that, when V and Nb were added in an amount of 0.1% by weight or more, the increment of the eutectoid transformation temperature was large remarkably. It is also apparent that, when W was added instead of Mo, W be required to be added in an amount twice that of Mo in order to produce the same advantageous effect equivalent to that produced by the Mo addition.

Figure 10:
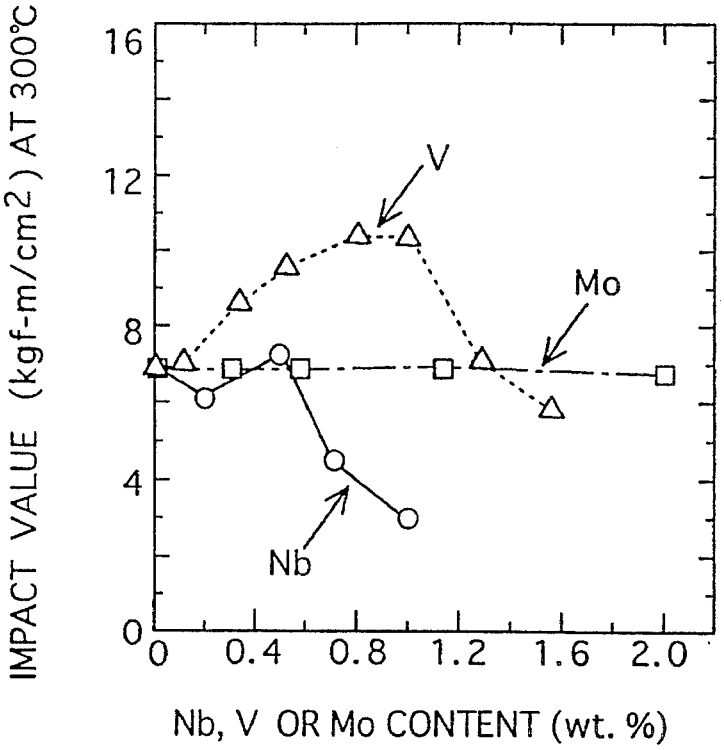
FIG. 10 is a diagram for illustrating how the V, Nb and Mo contents affected the toughness of the examples of the present ferritic heat-resistant cast steel.

FIG. 10 illustrates the results of the examination for how the V, Nb and Mo contents affected the toughness. When V was added in an amount of from 0.2 to 1.0% by weight to the master alloy, it improved the toughness. When Mo was added in an amount of up to 2.0% by weight thereto, it hardly affected the toughness. When Nb was added in amount of more than 0.4% by weight, it sharply degraded the toughness. Therefore, it is apparent that Nb be preferably added in a controlled amount of 0.4% or less thereto.

Figure 11:
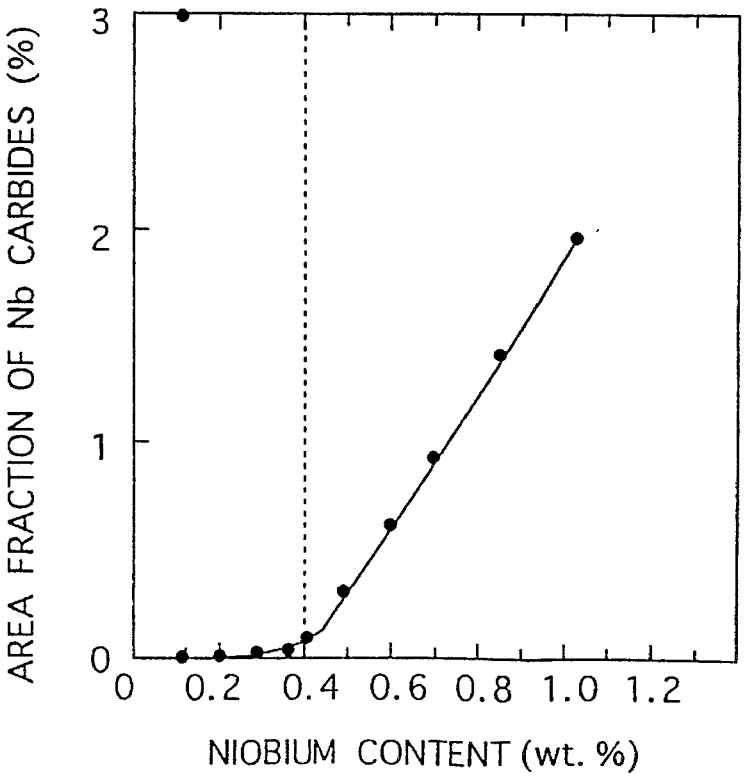
FIG. 11 is a diagram for illustrating the relationship between the Nb content of the examples of the present ferritic heat-resistant cast steel and the amount of Nb carbides crystallizing therein during the solidification.

FIG. 11 illustrates the results of the investigation on the relationship between the Nb content and the amount of Nb carbides crystallizing during the solidification. The area fraction of the Nb carbides was measured by subjecting the optical micro-graph of the metallic structure to an image analysis, thereby determining the amount of the Nb carbides. When the Nb content exceeded 0.4% by weight, the amount of the Nb carbides increased remarkably, thereby causing the carbides crystallizing solidification process. Taking the toughness degrading effect of Nb shown in FIG. 10 into consideration, it is obvious that the Nb content be preferably suppressed to 0.4% by weight or less.

Figure 12:
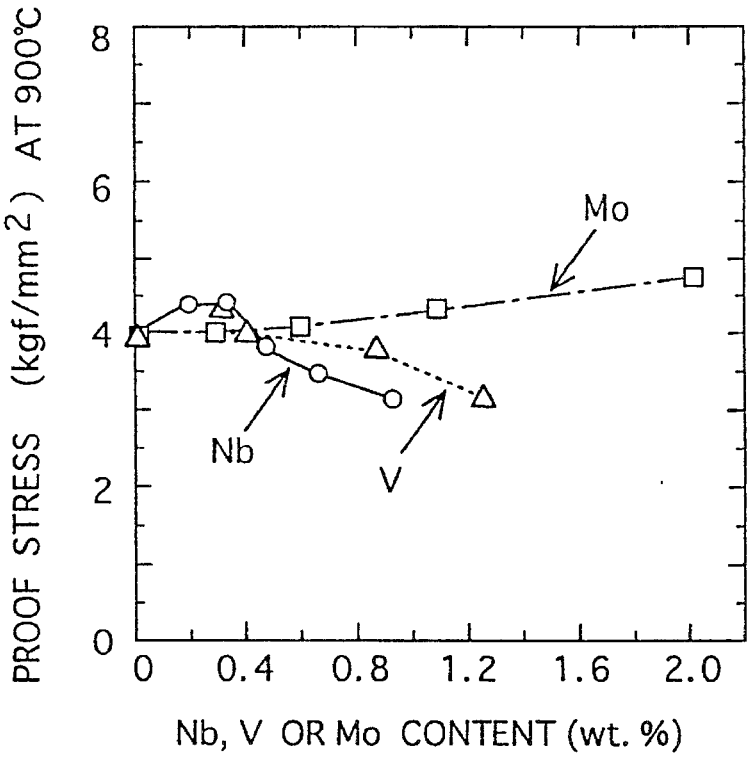
FIG. 12 is a diagram for illustrating how the V, Nb and Mo contents affected the elevated temperature proof stress of the examples of the present ferritic heat-resistant cast steel.

FIG. 12 illustrates the results of the evaluation on how the V, Nb and Mo contents affected the elevated temperature proof stress. It is apparent that Mo improved the elevated temperature proof stress. V did not adversely affect the property when it was added in an amount of up to 1.0% by weight. Nb enhanced the elevated temperature proof stress when it was added in amount of from 0.1 to 0.4% by weight.

Figure 13:
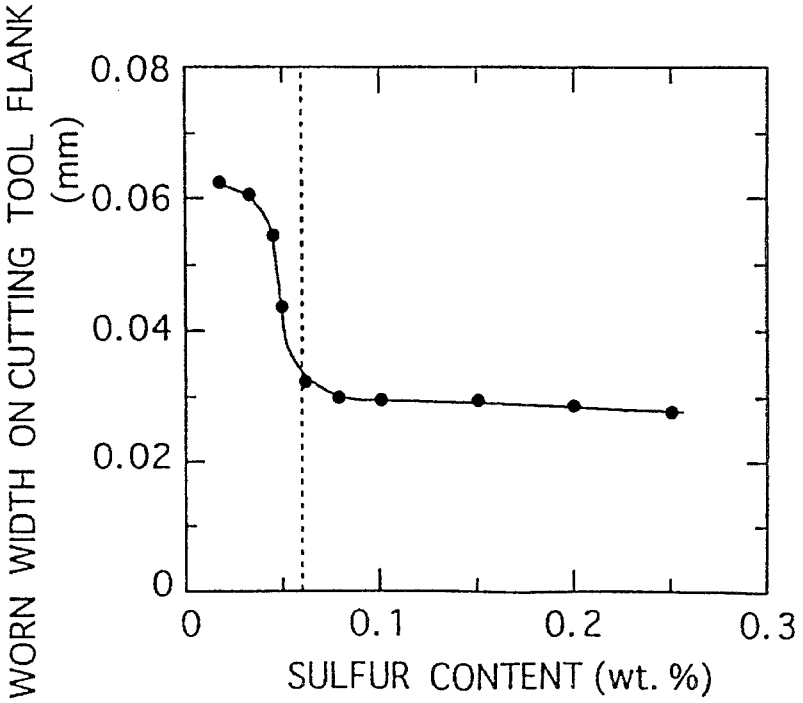
FIG. 13 is a diagram for illustrating how the sulfur content affected the machinability of the examples of the present ferritic heat-resistant cast steel.

FIG. 13 illustrates the results of the examination for how the sulfur content affected the machinability. When sulfur was added in an amount of 0.06% by weight or more, there appeared sharply diminishing worn width on the cutting tool flank. Thus, it is known that sulfur be added in an amount of 0.06% by weight or more.

In accordance with the novel discoveries described above, the examples of the present ferritic heat-resistant cast steel and the comparative examples thereto were prepared. The examples had the composition designated at Example Nos. 1 through 14, respectively, in Table 1 below. The comparative examples had the composition designated at Comparative Example Nos. 1 through 3, respectively, in Table 2 below.

The examples and the comparative examples were melted and cast to test specimens. The resulting test specimens were examined for their machinability, toughness, eutectoid transformation temperature, elevated temperature proof stress and thermal fatigue resistance. The testing methods for these properties were identical to those described above. Each of the tests was carried out after annealing the test specimens at 800° C. for 3 hours. The test specimens were also examined for the sulfides distribution in the metallic structure with an optical microscope. Not only the hardness of the test specimens (i.e., annealed test specimens) but also the hardness of the as-cast test specimens were measured, and the results were compared with each other.

TABLE 1

| | Chemical Component (% by weight, Balance: Fe) | | | | | | | | | | |
|---|---|---|---|---|---|---|---|---|---|---|---|
| Identification | C | Si | Mn | S | Ni | Cr | V | Nb | Mo | Te | Al |
| Example No. 1 | 0.20 | 0.5 | 1.00 | 0.06 | 1.00 | 20.0 | 0.61 | 0.10 | None | None | None |
| Example No. 2 | 0.21 | 1.0 | 0.60 | 0.15 | 0.11 | 16.0 | 0.59 | 0.21 | None | None | None |
| Example No. 3 | 0.20 | 2.0 | 0.11 | 0.20 | 0.10 | 13.0 | 0.75 | 0.40 | None | None | None |
| Example No. 4 | 0.20 | 1.0 | 0.60 | 0.13 | 0.15 | 16.3 | 0.20 | None | 2.00 | None | None |
| Example No. 5 | 0.25 | 1.5 | 0.58 | 0.12 | 0.11 | 16.2 | 1.00 | None | 0.10 | None | None |
| Example No. 6 | 0.10 | 0.6 | 0.95 | 0.14 | 0.90 | 15.0 | 0.20 | None | 1.05 | None | None |
| Example No. 7 | 0.40 | 1.8 | 0.15 | 0.13 | 0.06 | 19.5 | 0.80 | 0.37 | 1.50 | None | None |
| Example No. 8 | 0.22 | 1.5 | 0.55 | 0.14 | 0.16 | 17.0 | 0.62 | 0.30 | 0.30 | None | None |
| Example No. 9 | 0.25 | 1.4 | 0.52 | 0.14 | 0.11 | 18.1 | 0.62 | 0.31 | None | None | None |
| Example No. 10 | 0.21 | 1.4 | 0.56 | 0.14 | 0.09 | 16.3 | 0.58 | 0.20 | 0.25 | 0.01 | None |
| Example No. 11 | 0.18 | 1.3 | 0.81 | 0.07 | 0.12 | 16.5 | 0.61 | 0.18 | None | 0.10 | None |
| Example No. 12 | 0.22 | 1.3 | 0.90 | 0.14 | 0.09 | 16.8 | 0.55 | 0.15 | None | None | 0.01 |
| Example No. 13 | 0.24 | 1.4 | 0.35 | 0.10 | 0.15 | 17.0 | 0.65 | 0.25 | 0.12 | None | 0.50 |
| Example No. 14 | 0.23 | 1.2 | 0.45 | 0.09 | 0.12 | 16.4 | 0.40 | 0.30 | 0.40 | 0.05 | 0.10 |

TABLE 2

| | Chemical Component (% by weight, Balance: Fe) | | | | | | | | | |
|---|---|---|---|---|---|---|---|---|---|---|
| Identification | C | Si | Mn | S | Ni | Cr | V | Nb | Mo | Ce |
| Comp. Ex. No. 1 | 0.33 | 2.2 | 0.51 | 0.03 | 0.30 | 13.1 | None | None | None | None |
| Comp. Ex. No. 2 | 0.20 | 1.5 | 0.60 | 0.14 | 0.08 | 16.1 | 0.42 | 0.74 | 0.18 | 0.05 |
| Comp. Ex. No. 3 | 3.91 | 4.1 | 0.43 | 0.02 | None | None | None | None | None | None |

TABLE 3

| Identification | Worn Width on Cutting Tool Flank (mm) |
|---|---|
| Example No. 1 | 0.037 |
| Example No. 2 | 0.033 |
| Example No. 3 | 0.030 |
| Example No. 4 | 0.032 |
| Example No. 5 | 0.033 |
| Example No. 6 | 0.033 |
| Example No. 7 | 0.032 |
| Example No. 8 | 0.032 |
| Example No. 9 | 0.031 |
| Example No. 10 | 0.028 |
| Example No. 11 | 0.025 |
| Example No. 12 | 0.028 |
| Example No. 13 | 0.026 |
| Example No. 14 | 0.026 |
| Comp. Ex. No. 1 | 0.075 |

TABLE 3-continued

| Identification | Worn Width on Cutting Tool Flank (mm) |
|---|---|
| Comp. Ex. No. 2 | 0.035 |
| Comp. Ex. No. 3 | 0.024 |

Table 3 summarizes the results of the machinability test. As set forth in Table 3, all of the examples of the present ferritic heat-resistant cast steel were far superior to Comparative Example No. 1 (i.e., SCH1 as per JIS) including sulfur in a suppressed amount of 0.04% by weight or less in terms of the machinability. Further, even when they included sulfur in an amount equal to that of Comparative Example No. 2 whose sulfur content is said to be able to increase up to 0.2% by weight, they exhibited the toughness equivalent to or better than that of Comparative Example No 2. Furthermore, they had the machinability equivalent to that of Comparative Example No. 3 (i.e., the high-silicon-content nodular graphite cast iron). Moreover, the examples including Te or Al (e.g., Examples Nos. 10 through 14) were superior to that of the examples free from Te or Al.

TABLE 4

| Identification | Impact Value (kgf-m/cm$^2$) |
|---|---|
| Example No. 1 | 5.05 |
| Example No. 2 | 4.73 |
| Example No. 3 | 4.25 |
| Example No. 4 | 4.35 |
| Example No. 5 | 5.24 |
| Example No. 6 | 4.47 |
| Example No. 7 | 5.43 |
| Example No. 8 | 4.86 |
| Example No. 9 | 4.54 |
| Example No. 10 | 4.32 |
| Example No. 11 | 4.77 |
| Example No. 12 | 4.33 |
| Example No. 13 | 4.45 |
| Example No. 14 | 4.42 |
| Comp. Ex. No. 1 | 5.51 |
| Comp. Ex. No. 2 | 0.95 |
| Comp. Ex. No. 3 | 0.43 |

Table 4 sets forth the results of the Charpy impact test at 300° C. All of the examples of the present ferritic heat-resistant cast steel had a larger impact value than that of Comparative Example No. 2. Therefore, it is apparent that they were superb in terms of the toughness.

TABLE 5

| Identification | Transformation Temperature (°C.) |
|---|---|
| Example No. 1 | 1,025 |
| Example No. 2 | 1,005 |
| Example No. 3 | 1,030 |
| Example No. 4 | 980 |
| Example No. 5 | 995 |
| Example No. 6 | 985 |
| Example No. 7 | 980 |
| Example No. 8 | 1,000 |
| Example No. 9 | 985 |
| Example No. 10 | 985 |
| Example No. 11 | 990 |
| Example No. 12 | 985 |
| Example No. 13 | 1,040 |
| Example No. 14 | 1,000 |
| Comp. Ex. No. 1 | 880 |
| Comp. Ex. No. 2 | 990 |
| Comp. Ex. No. 3 | 820 |

Table 5 summarizes the results of the eutectoid transformation temperature measurement. All of the examples of the present ferritic heat-resistant cast steel exhibited a higher eutectoid transformation temperature than that of Comparative Example Nos. 1 and 3. Further, their eutectoid transformation temperatures were substantially equal to or higher than that of Comparative Example No. 2.

TABLE 6

| Identification | Elevated Temperature 0.2% Proof Stress (kgf/mm$^2$) |
|---|---|
| Example No. 1 | 4.0 |
| Example No. 2 | 4.2 |
| Example No. 3 | 4.3 |
| Example No. 4 | 5.0 |
| Example No. 5 | 4.4 |
| Example No. 6 | 4.2 |
| Example No. 7 | 4.7 |
| Example No. 8 | 4.3 |
| Example No. 9 | 4.2 |
| Example No. 10 | 4.1 |
| Example No. 11 | 4.0 |
| Example No. 12 | 4.1 |
| Example No. 13 | 4.3 |
| Example No. 14 | 4.4 |
| Comp. Ex. No. 1 | — |
| Comp. Ex. No. 2 | 3.3 |
| Comp. Ex. No. 3 | — |

Table 6 recites the results of the elevated temperature 0.2% proof stress measurement. All of the examples of the present ferritic heat-resistant cast steel had a proof stress equivalent to or better than that of Comparative Example No. 2. In particular, the examples with Mo added (e.g., Examples Nos. 4 through 8, No. 10 and Nos. 13 through 14) were better than the examples free from Mo in terms of the elevated temperature proof stress.

TABLE 7

| Identification | Thermal Fatigue Life (cycles) |
|---|---|
| Example No. 1 | 730 |
| Example No. 2 | 700 |
| Example No. 3 | 650 |
| Example No. 4 | 780 |
| Example No. 5 | 710 |
| Example No. 6 | 680 |
| Example No. 7 | 750 |
| Example No. 8 | 690 |
| Example No. 9 | 720 |
| Example No. 10 | 710 |
| Example No. 11 | 700 |
| Example No. 12 | 740 |
| Example No. 13 | 780 |
| Example No. 14 | 760 |
| Comp. Ex. No. 1 | 190 |
| Comp. Ex. No. 2 | 480 |
| Comp. Ex. No. 3 | 22 |

Table 7 sets forth the results of the thermal fatigue test. As compared to the thermal fatigue life exhibited by Comparative Example Nos. 1 and 3, it required a larger number of repetitive cycles for all of the examples of the present ferritic heat-resistant cast steel until they fractured. Hence, it is apparent that they were remarkably excellent in terms of the thermal fatigue resistance. Further, their thermal fatigue resistance was far superior to that of Comparative Example No. 2. Furthermore, the examples including Al (e.g., Examples Nos. 12 through 14) were better than the examples free from Al in terms of the thermal fatigue resistance.

Figure 14:
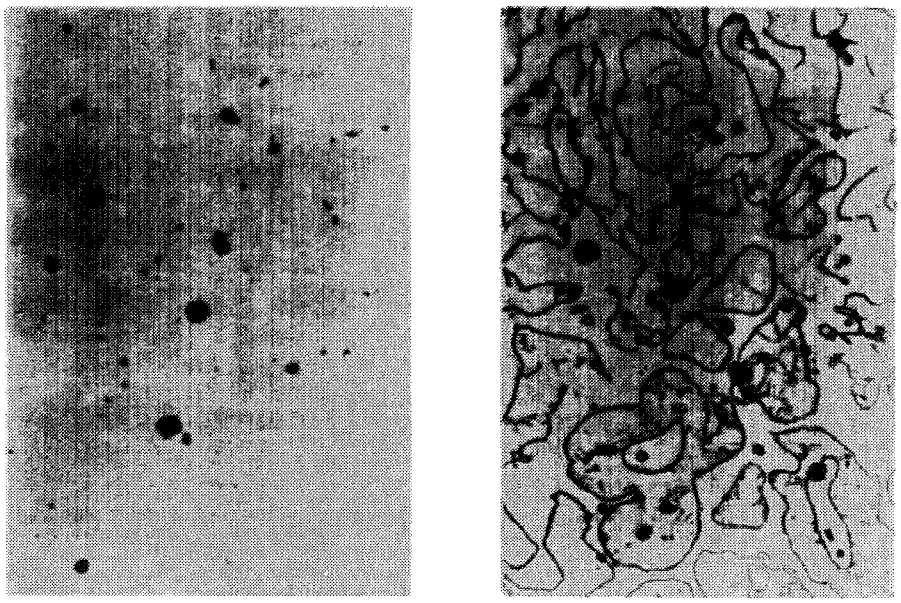
FIG. 14 is a set of photographs for showing the metallic structure of the example of the present ferritic heat-resistant cast steel and the comparative example thereto.
Figure 14:
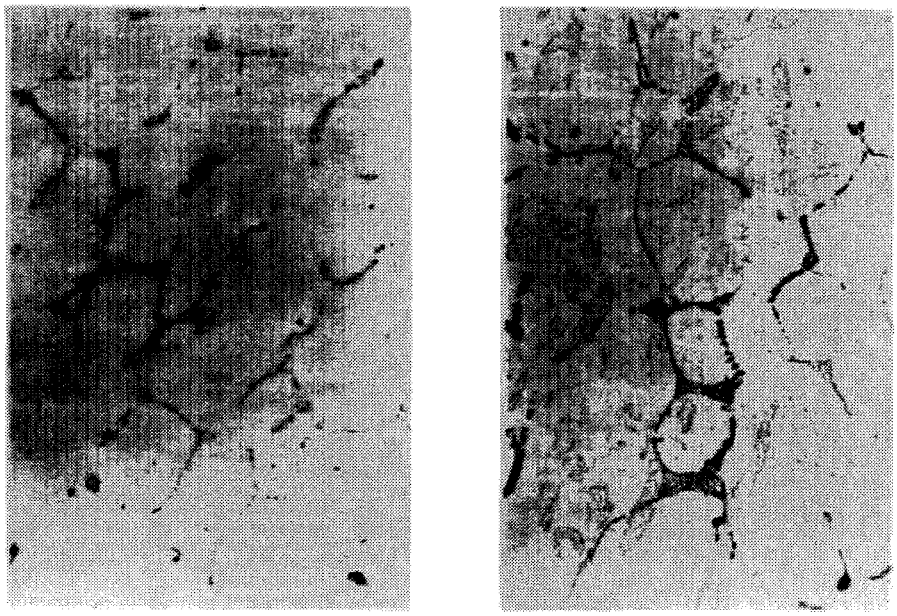

FIG. 14 illustrates the results of the optical microscope observation on the metallic structure of Example No. 2 of the present ferritic heat-resistant cast steel and Comparative Example No. 2 thereto. On the left-hand side of the drawing, there are shown the metallic structures which were not etched. On the right-hand side of the drawing, there are shown the metallic structures which were etched. It is appreciated that, in the metallic structure of Comparative Example No. 2, the Nb carbides were present like a network and the sulfides were localized along the Nb carbides. On the contrary, it is clearly understood that, in the metallic structure of Example No. 2, the sulfides were distributed substantially uniformly.

TABLE 8

| Identification | Vickers Hardness (Hv) As-cast Test Specimen | Vickers Hardness (Hv) Annealed Test Specimen |
|---|---|---|
| Example No. 1 | 213 | 195 |
| Example No. 2 | 275 | 198 |
| Example No. 3 | 310 | 205 |
| Example No. 5 | 255 | 197 |
| Example No. 9 | 218 | 200 |
| Example No. 12 | 230 | 196 |

Table 8 summarizes the results of the hardness test. Example Nos. 1, 9 and 12 exhibited a sufficiently low hardness when they were as-cast, and they exhibited a further reduced hardness when they were annealed at 800° C. for 3 hours. Since Example Nos. 2, 3 and 5 contained the martensite in a large amount when they were as-cast, they exhibited a high hardness. However, since the martensite was transformed to the ferrite by the annealing, Example Nos. 2, 3 and 5 were found to soften appropriately. In addition, even when the annealing was carried out at a temperature of from 750° to 1,000° C. for from 1 to 5 hours, the examples subjected to this annealing produced the similar advantageous effect.

Having now fully described the present invention, it will be apparent to one of ordinary skill in the art that many changes and modifications can be made thereto without departing from the spirit or scope of the present invention as set forth herein including the appended claims.

What is claimed is:

1. A ferritic heat-resistant cast steel, comprising:

C in an amount of from 0.15 to 0.38% by weight;

Si in an amount of from 0.5 to 2.0% by weight;

Mn in an amount of 1.0% by weight or less;

S in an amount of from 0.06 to 0.20% by weight;

Ni in an amount of 1.0% by weight or less;

Cr in an amount of from 13 to 20% by weight;

V in an amount of from 0.2 to 1.0% by weight;

at least one element selected from the group consisting of Nb in an amount of from 0.1 to 0.4% by weight, Mo in an amount of from 0.1 to 2.0% by weight, and W in an amount of from 0.2 to 4.0% by weight; and the balance of Fe and inevitable impurities, said S being dispersed as sulfides in said ferritic heat-resistant cast steel.

2. The ferritic heat-resistant cast steel according to claim 1 further comprising at least one element selected from the group consisting of Te in an amount of from 0.01 to 0.1% by weight and Al in an amount of from 0.01 to 0.5% by weight.

3. The ferritic heat-resistant cast steel according to claim 2 comprising Te in an amount of from 0.02 to 0.08% by weight.

4. The ferritic heat-resistant cast steel according to claim 2 comprising Al in an amount of from 0.02 to 0.4% by weight.

5. The ferritic heat-resistant cast steel according to claim 1 comprising Si in an amount of from 0.8 to 1.7% by weight.

6. The ferritic heat-resistant cast steel according to claim 1 comprising Mn in an amount of from 0.2 to 0.8% by weight.

7. The ferritic heat-resistant cast steel according to claim 1 comprising S in an amount of from 0.08 to 0.18% by weight.

8. The ferritic heat-resistant cast steel according to claim 1 comprising Ni in an amount of from 0.01 to 0.9% by weight.

9. The ferritic heat-resistant cast steel according to claim 1 comprising Cr in an amount of from 15 to 19% by weight.

10. The ferritic heat-resistant cast steel according to claim 1 comprising V in an amount of from 0.4 to 0.8% by weight.

11. The ferritic heat-resistant cast steel according to claim 1 comprising Nb in an amount of from 0.15 to 0.35% by weight.

12. The ferritic heat-resistant cast steel according to claim 1 comprising Mo in an amount of from 0.2 to 1.5% by weight.

13. The ferritic heat-resistant cast steel according to claim 1, wherein said ferritic heat-resistant cast steel comprises a mixed phase including ferrite phase and austenite phase immediately after solidification.

14. The ferritic heat-resistant cast steel according to claim 13, wherein the austenite phase occupies from 20 to 80% by area of the mixed phase.

15. A process for producing a ferritic heat-resistant cast steel, comprising the steps of:

selecting and casting a raw material having a composition recited in either claim 1 or 2; and annealing the resulting cast product at a temperature of from 750° to 1,000° C.

16. The process according to claim 15, wherein said step of annealing is carried out for from 1 to 5 hours.

17. A ferritic heat-resistant cast steel, comprising:

C in an amount of from 0.1 to 0.4% by weight;

Si in an amount of from 0.5 to 2.0% by weight;

Mn in an amount of 1.0% by weight or less;

S in an amount of from 0.06 to 0.20% by weight;

Ni in an amount of 1.0% by weight or less;

Cr in an amount of from 13 to 20% by weight;

V in an amount of from 0.2 to 1.0% by weight;

at least one element selected from the group consisting of Nb in an amount of from 0.1 to 0.4% by weight, Mo in an amount of from 0.1 to 2.0% by weight, and W in an amount of from 0.2 to 4.0% by weight; and the balance of Fe and inevitable impurities, so as to cause peritectic reaction during solidification, thereby dispersing said S in said ferritic heat-resistance cast steel as sulfides.

* * * * *